United States Patent [19]

Walkhoff

[11] Patent Number: 4,901,454

[45] Date of Patent: Feb. 20, 1990

[54] SKI BOOT

[75] Inventor: Klaus Walkhoff, Kreuzlingen, Switzerland

[73] Assignee: Raichle Sportschuh AG, Kreuzlingen, Switzerland

[21] Appl. No.: 243,290

[22] Filed: Sep. 9, 1988

[30] Foreign Application Priority Data

Sep. 18, 1987 [CH] Switzerland ..... 03609/87

[51] Int. Cl.[4] ..... A43B 5/04

[52] U.S. Cl. ..... 36/117; 36/39; 280/607

[58] Field of Search ..... 36/117–121, 36/39, 34 A, 36 B, 73, 130; 280/607, 613

[56] References Cited

U.S. PATENT DOCUMENTS

| | | | |
|---|---|---|---|
| 3,085,359 | 4/1963 | Rubens | 36/39 |
| 3,195,244 | 7/1965 | Whitcas | 36/130 |
| 3,477,150 | 11/1969 | Shepherd | 36/39 |
| 3,744,160 | 7/1973 | Dymond . | |
| 4,317,295 | 3/1982 | Hanson | 36/117 |
| 4,392,666 | 7/1983 | Ramer | 36/117 X |

FOREIGN PATENT DOCUMENTS

| | | | |
|---|---|---|---|
| 2659586 | 7/1978 | Fed. Rep. of Germany | 280/607 |
| 99020 | 11/1961 | Norway | 280/607 |

*Primary Examiner*—James Kee Chi

*Attorney, Agent, or Firm*—Collard, Roe & Galgano

[57] ABSTRACT

A ski boot is provided having a heel element rotatable about an axis in the heel piece which, by means of screw bolts, is secured on the wall of the sole of the boot within the region of the heel of the ski boot. The axis extends essentially perpendicularly to the surface of the sole of the boot. The foot covering of the rotatable heel element comes to bear on the support plate of the ski brake when the ski boot is secured to the ski by means of the front and back bindings. Because the heel element is rotatable, the friction relationship between the heel element and the support plate no longer impacts on the release characteristics of the front binding in the event of a fall occurring while turning or of a fall resulting from a head-forward fall during turning.

9 Claims, 2 Drawing Sheets

SKI BOOT

Figure 1:
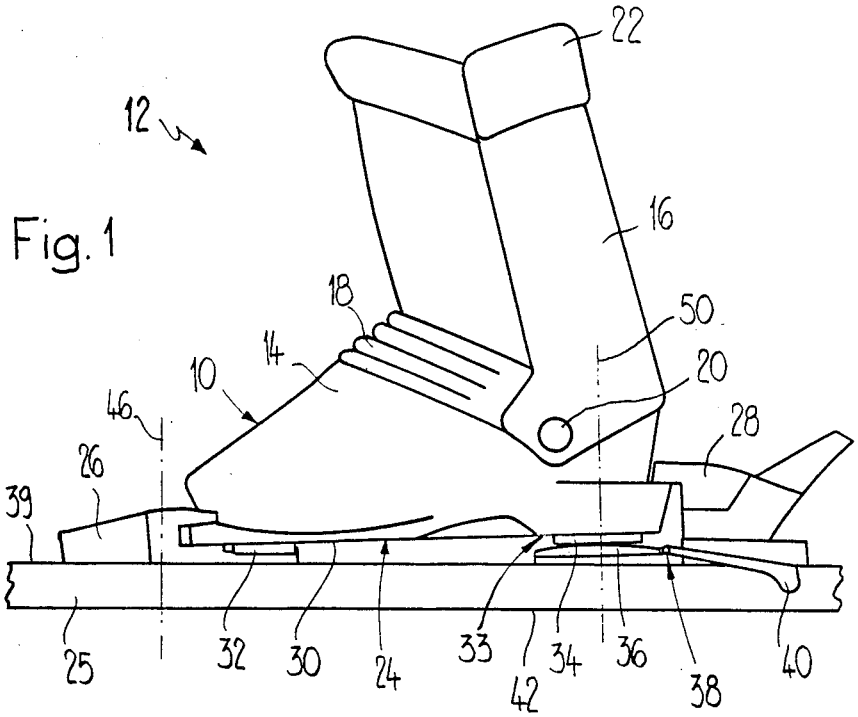

The present invention relates to a ski boot and, more particularly, to a ski boot having a heel element which results in the reduction of friction between the ski boot heel and the ski boot support on the ski.

Alpine skis are usually outfitted with safety bindings, consisting of front and rear bindings which maintain the ski boot, in the toe and heel area, in a locked but releasable position on the ski. The front binding, during falls occurring while turning, normally releases along an axis perpendicular to the surface of the ski while the rear binding releases during head-forward falls. With falls occurring during a turn, there is the problem that the release characteristics of the front binding can be affected by unspecified and uncontrollable friction relationships existing between the heel of the ski boot and its support, for example, a support plate of the rear binding or a ski brake's foot plate. Delayed release of the front binding can occur if the sole of the heel of the ski boot and the support or foot plate of the binding have profiles which, when the skis are not in use, interfere with or catch each other or which, during release of the binding, can interfere with or catch each other. In order to assure safe skiing, a good profile of the ski boot sole cannot be sacrificed. The rear binding presses the ski boot, in the area of the heel, with considerable force against its support. This circumstance, even where this aspect of sole and support profile may be disregarded, results in the fact that application of considerable force is required to turn the heel as long as the boot is still being held in position in the binding.

It is the object of the present invention to provide a ski boot whose friction relationship between the heel and its support do not affect the operational safety of the ski binding, especially during falls occurring while turning.

This object is accomplished in accordance with the present invention by providing a heel element in the ski boot rotatable about an axis which is substantially perpendicular to the ski boot sole and which can be brought to bear on a support located on the ski.

In a preferred embodiment of the present invention, the heel element is embedded in a heel piece and protrudes downwardly from the heel piece. This enables the heel element dimensions to be kept small, and the heel element can be given a good profile so that safe walking movement is possible.

In a further preferred embodiment, the heel element is shaped like a plate and can be secured by means of a snap connection on the heel piece. This enables simple and secure mounting of the heel element as well as its effortless replacement.

The heel element and heel piece preferably have opposing ring-shaped or circular sliding surfaces which essentially lie at a right angle to the heel element axis. This enables friction to be minimized and prevents the heel element from rocking vis-à-vis the heel piece.

Other objects and features of the present invention will become apparent from the following detailed description considered in connection with the accompanying drawings. It is to be understood, however, that the drawings are designed as an illustration only and not as a definition of the limits of the invention.

Figure 2:
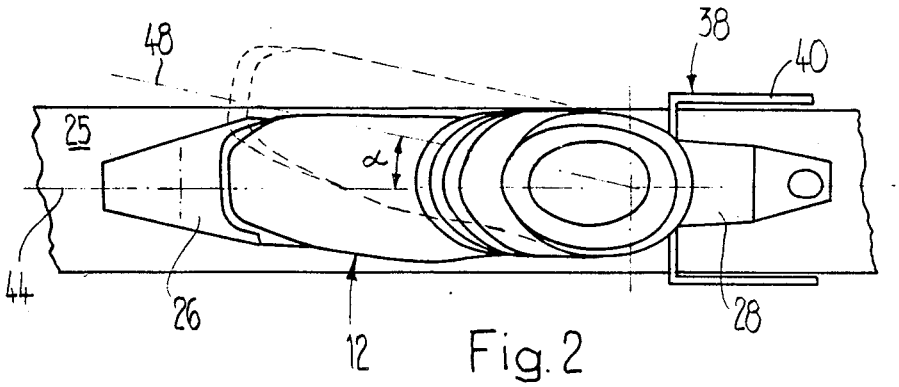
Figure 3:
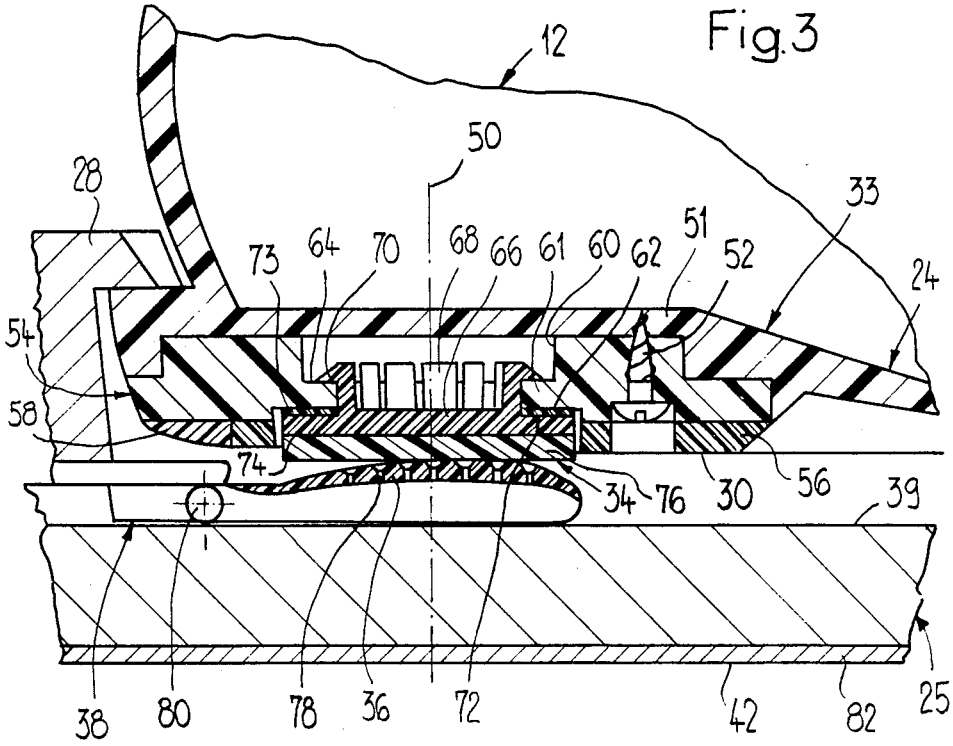
Figure 4:
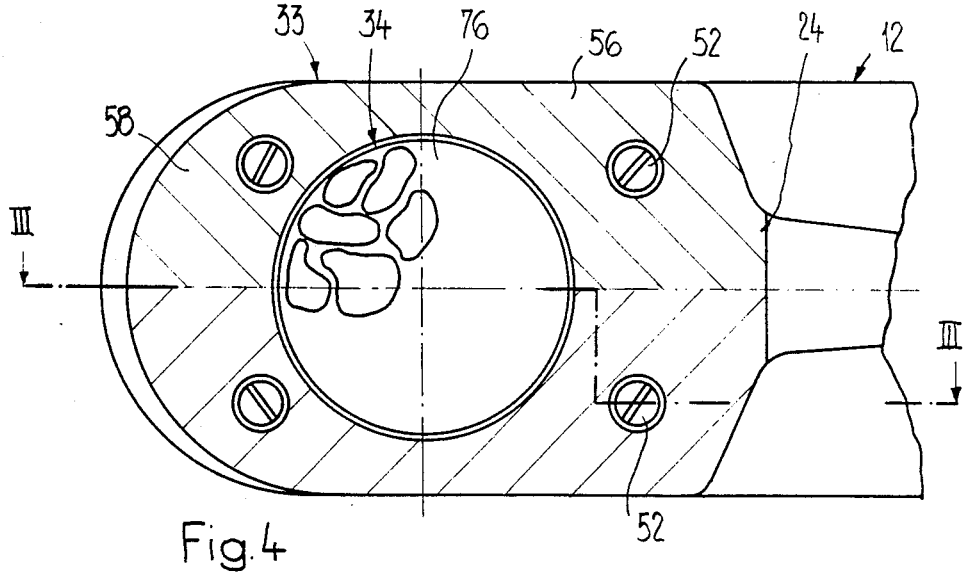

In the drawings, wherein similar reference characters denote similar elements throughout the several views:

FIG. 1. is a side elevational view of a ski boot locked in position on a ski by means of a safety binding;

FIG. 2. is a top plan view of the ski and ski boot according to FIG. 1;

FIG. 3. is an enlarged cross-sectional view of the heel region of the ski boot taken along line 111—111 of FIG. 4; and FIG. 4. is a bottom plan view of the heel region of the ski boot of FIG. 3.

Now turning to the drawings, there is shown in FIG. 1 a ski boot 12 having a vamp 10 which consists of a front and rear shell 14 and 16, respectively. Front shell 14 overlaps the skier's foot in the area of the toe and instep as well as the front, lower portion of the tibia and transverse ribbing 18, between the instep and the tibia, allows the skier's tibia to bend in a forward direction. Rear shell 16, which encompasses the back and lower part of the tibia, is pivoted on front shell 14 in the region of the heel by means of a hinge 20. Both shells 14 and 16, which are preferably made of plastic, are interconnected by a locking device which is not shown. A padded inner shoe 22, which projects out and above both shells 14 and 16 is provided in the interior of vamp 10.

In the front tip area and in the area of the heel, a sole 24 of ski boot 12 is gripped by a binding 26 and 28 respectively, attached to a ski 25. A sole surface 30 bears upon a support plate 32 of the front binding 26, while a heel element 34 located in the region of heel 33 bears upon a tread or support plate 36 of ski brake 38. Ski brake 38 is secured in place by heel element 34 in the position shown in FIG. 1. If the ski boot is released as a result of a fall or through the release of rear binding 28, brake 38, which is spring loaded and rotatably attached to the surface 39 of ski 25, tilts about 90 degrees clockwise, such that lateral brake hooks 40 protrude below sliding surface 42 of ski 25, preventing an uncontrolled descent of the ski.

In FIG. 2, the above-indicated parts are designated by the same reference numbers used in FIG. 1. These parts will be discussed only to the extent their discussion is necessary to make the invention understandable. The solid lines depict ski boot 12 in its normal position, i.e., secured in place on ski 25 by means of the front and rear bindings 26 and 28. If a forward fall occurs, the rear binding releases, pivoting on an axis parallel to the surface 39 of ski 25 and perpendicular to the longitudinal axis 44 of the ski, thus releasing heel portion 33 of ski boot 12, such that this heel portion can separate from ski 25.

In contrast, if a fall occurs during a turn, front binding 26 must also release the ski boot. To this end, front binding 26 pivots about an axis of rotation 46 which extends perpendicularly to the surface 39 of the ski (see FIG. 1). The phantom lines in FIG. 2 depict ski boot 12 in the course of its being released by front binding 26. Its longitudinal axis 48 has, in the process, moved through the angle from longitudinal axis 44 of the ski about another axis 50 (see FIG. 1), which extends perpendicularly to the surface 30 of sole 24 and which is located in the region of heel 33 of the sole 24. Ski boot 12 also rotates about this axis 50 when a forward fall occurs because, during release of ski boot 12 from rear binding 28, support, plate 36 of brake 38 follows heel element 34.

As seen in FIGS. 3 and 4, in the region of heel 33 bushing 54 is attached to a wall 51 of the sole by means of four screw bolts 52. Heel bushing 54 is covered, on the bottom, by a fishbone-like profile and sole piece 56, whose rear extremity is augmented by a replaceable rubber element 58.

Heel bushing 54 is provided with a stepped recess 60 which is concentric to axis 50 with a ring-shaped rib which is bounded in a radial direction toward the bottom by a sliding surface 62 which is perpendicular to axis 50 and on top by a locking surface 64 parallel thereto. A member 66 of heel element 34 rotates on rib 61. Member 66 is shaped like a plate and displays a concentric ring consisting of locking clasps 68, whose locking catches or tangs 70 grip locking surfaces 64 from behind. Member 66 has an additional circular sliding surface 72 which is parallel to sliding surface 62 of the heel bushing. A circular sheeting 73 made of polytetrafluorethylene is located between sliding surfaces 62 and 72 which reduces friction between the sliding surfaces. The bottom 74 of member 66 is provided with a profiled tread covering 76 made of soft plastic. Compressive strength of tread covering 76 is less than that of member 66 which functions as the bearing element. Tread covering 76 bears on foot plate 36 of brake 38 and protrudes downwardly from sole piece 56. Tread plate 36 is made of plastic and is provided with holes 78 which form a profile. The pivot shaft of brake 38 is identified by reference number 80. Sliding surface 42 is the surface covering of a ski 82.

With the ski boot according to the invention, the friction relationships between tread plate 36 of brake 38 and sole 24 of ski boot 12 no longer has an effect on the release of front binding 26 during a fall occasioned by turning or when a head-forward fall occurs during turning. Heel element 34 is rotated in heel piece 54 in such a way that it can retain its position relative to tread plate 36 while the remaining portion of ski boot 12 rotates about axis 50. Sliding surfaces 62 and 72 and ring 73 limit friction to a very small degree.

In the event the ski 25 is not outfitted with a brake 38, a rear support plate, upon which heel element 34 bears, takes the place of the tread plate 36. Even when the ski is so configured the friction relationship between this support plate and heel element 34 in no way impact on the release of front binding 26.

To assure safe walking movement, tread covering 76 can be provided with a profile which is formed, for example, by irregularly spaced nubs.

Because heal bushing 54 is firmly secured to the wall 51 of the sole by screws, it can be effortlessly replaced along with the heel element 34, should this become necessary because of wear and tear to the sole piece 56 or tread covering 76. Replacement of the heel bushing alone is possible by releasing locking catches 70 from locking surfaces 64, removing heel element 34 from the heel piece 54 and by inserting a new heel element 34 into recess 60 and securing it to locking surfaces 64.

Roller bearings or ball bearings can be installed between the sliding surfaces 62 and 72 instead of friction-reducing circular sheeting 73. These friction-reducing media can be dispensed with in the event heel piece 54 and heel element 34, at least in the area of sliding surfaces 62 and 72, are made of materials which produce little friction in the contact surface area they share in common.

Heel element 34 and/or heel piece 54 may be composite moulded parts, with heel piece 54 and member 66 being made of plastic and having, on their bottom, an anti-abrasive surface whose compressive strength is less than that of heel piece 54 and member 66.

It is also conceivable that rotatable heel element 34 is constituted by the entire area of heel 33.

While only a single embodiment of the present invention has been shown and described, it will be obvious that many changes and modifications may be made thereunto without departing from the spirit and scope of the invention.

What is claimed is:

1. A ski boot having a vamp and a sole and including a heel area, comprising a heel element rotatable in an area of the heel about an axis which substantially extends perpendicuarly to the surface of the sole, which heel element can be brought to bear on a support located on a ski.

2. The ski boot according to claim 1, wherein said heel element is located in a heel piece which extends downwardly beyond the heel element.

3. The ski boot according to claim 2, wherein said heel element is shaped like a plate and can be secured by means of a snap connection on said heel piece.

4. The ski boot according to claim 3, wherein said heel element is shaped like a plate and displays a concentric ring of locking clasps which grip on a locking surface of the heel piece from behind.

5. The ski boot according to claim 2, wherein said heel element and heel piece have opposing ring-shaped sliding surfaces which substantiálly lie perpendicularly to the axis of the heel element.

6. The ski boot according to claim 5, wherein friction reducing media are provided between the sliding surfaces.

7. The ski boot according to claim 5, wherein said heel element and said heel piece, at least in the area of their sliding surfaces are made of two different materials, preferably synthetics, which produce little friction in the contact surface area they share in common.

8. The ski boot according to claim 1, wherein said heel element has a member, preferably made of plastic, whose bottom is provided with a non-directionally oriented profiled covering whose compressive strength is less than that of said member.

9. The ski boot according to claim 1, wherein said heel piece and heel bushing are composite moulded parts, having an anti-brasive surface whose compressive strength is less than that of said heel piece.

* * * * *